US006145267A

United States Patent [19]

Pardo

[11] Patent Number: 6,145,267

[45] Date of Patent: Nov. 14, 2000

[54] INTERLOCKING BLOCKS OF PRECISE HEIGHT

[76] Inventor: Jorge Pardo, P.O. Box 3335, Reston, Va. 22090

[21] Appl. No.: 08/937,153

[22] Filed: Sep. 25, 1997

[51] Int. Cl.[7] ..... E04B 2/54

[52] U.S. Cl. ..... 52/606; 52/605; 52/609; 52/692.1

[58] Field of Search ..... 52/604, 605, 609, 52/592.1, 592.6, 589.1, 596, 424, 426, 606

[56] References Cited

U.S. PATENT DOCUMENTS

| | | | |
|---|---|---|---|
| 900,753 | 10/1908 | Mahler . | |
| 1,680,626 | 8/1928 | Meyer . | |
| 4,319,440 | 3/1982 | Rassias et al. | 52/438 |
| 4,473,985 | 10/1984 | Hunt | 52/593 |
| 4,993,206 | 2/1991 | Pardo . | |
| 5,086,600 | 2/1992 | Holland et al. | 52/594 |
| 5,379,565 | 1/1995 | Vienne | 52/606 |
| 5,457,926 | 10/1995 | Jensen | 52/604 |
| 5,459,971 | 10/1995 | Sparkman | 52/426 |
| 5,709,060 | 1/1998 | Vaughan et al. | 52/426 |
| 5,729,943 | 3/1998 | Cambiuzzi | 52/438 |
| 5,788,423 | 8/1998 | Perkins | 405/284 |
| 5,802,797 | 9/1998 | Storer-Folt | 52/604 |
| 5,845,449 | 12/1998 | Vaughan et al. | 52/565 |

*Primary Examiner*—Carl D. Friedman
*Assistant Examiner*—Yvonne Horton
*Attorney, Agent, or Firm*—Lane, Aitken & McCann, L.L.P.

[57] ABSTRACT

An interlocking block for constructing walls without mortar at bed joints includes an inner wall, an outer wall, and a web arrangement connecting the walls, wherein upper and lower surfaces of the block when in use are formed in contact with walls of a mold, and the block is slipped from the mold in a direction parallel to the mold walls. Interlocking recesses and ridges are formed in one piece with the walls of the block. The web is minimal in cross-sectional area and is positioned at one end of the block and between the top and bottom to create large empty volumes defining vertical and horizontal passages. The block can include one or more intermediate walls parallel to the inner and outer walls and additional webs to connect the intermediate walls to the inner and outer walls.

21 Claims, 3 Drawing Sheets

INTERLOCKING BLOCKS OF PRECISE HEIGHT

BACKGROUND OF THE INVENTION

The present invention relates to building blocks and, more particularly, to interfitting construction units, or blocks, of precise height for constructing walls and buildings without mortar in the bed joints.

Walls and buildings constructed of, for example, concrete blocks require mortar at the bed joints, the horizontal interfaces between the blocks, in order to provide a level horizontal surface for each course of the blocks. This is due to the fact that concrete blocks and the like are manufactured in such a manner that the height of the blocks, from block to block and within each block, lacks adequate uniformity and precision. Most of the cost in constructing a wall of concrete blocks is in the labor needed to construct it, and it has been estimated that using mortar at the bed joints and levelling the blocks to make the horizontal surfaces of each course level and even accounts for about 70% of the labor cost.

Concrete blocks are made by filling a mold with concrete such that the bottom (or top) of the block, as the block will be positioned in the mold, coincides with the bottom of the mold. Then, the bottom of the mold is moved downward from the rest of the mold, and the block is moved downward with the bottom of the mold until the block is free to be moved off the mold bottom. This is done every 6 to 7 seconds. With this standard method, there is very limited uniformity and precision in the height dimension of the resultant blocks. Industry standards require only that there be no more than ⅛ inch, that is, + or −1/16 inch, variation of the height dimension in a block.

Without mortar, that is, with the blocks contacting the blocks of adjacent courses, at least portions of courses would not be level, and some of the blocks of a particular course would be higher than other blocks in the same course. In addition, due to such unevenness, there is misfitting of the blocks, which results in stress concentrations and, sometimes, failures. Also due to the unevenness, structures supported by such courses, such as beams, are contacted by only a portion of the area of the course which should contact the supported structure. There are spaces between the supported structures and other portions of the upper course which should contact the supported structures. As a result, stress concentrations are created in the course and in the supported structure, and the course or the supported structure sometimes fails.

SUMMARY OF THE INVENTION

By the present invention, building blocks are provided which are sufficiently uniform and precise in height that they can be used to construct walls without using mortar at the bed joints. The blocks can be stacked on one another with each block contacting the blocks above and below to produce walls having a precisely level and even upper surface. The blocks have integral interlocking formations formed in one piece with the blocks to enable each block to interlock with the blocks above and below. As a result, the labor and cost of building a wall of blocks is greatly reduced, and the construction process is made substantially faster.

In order to obtain the precise height, the blocks are molded with their height in a horizontal orientation. In other words, the blocks are molded in an orientation which is at a 90° angle with respect to the orientation of the blocks when they are in a wall. The orientation during molding is also at a 90° angle with respect to the conventional orientation for molding blocks. In the molding of the blocks according to the present invention, the surfaces which will define the top and the bottom of a block when the block is in a wall are in contact with the sides of the mold, which are fixed and which define a precise dimension between themselves. Since the blocks are slipped from the mold through the bottom and, thus, parallel to the sides of the mold, the distance between the surfaces which will be the top and the bottoms of the blocks in use that is, the height, is precise. The precision is retained as the blocks are slid down and out of the mold.

The blocks include an inner wall and an outer wall, each having four surfaces defining a rectangular perimeter, and a web connecting the inner wall to the outer wall. The blocks can also include one or more intermediate walls which are spaced from and generally parallel to the inner wall and the outer wall. The intermediate walls can be used for blocks having greater depth, the dimension from front to back. Where an intermediate wall is present, a first web connects the inner wall to the intermediate wall, and a second web connects the intermediate wall to the outer wall. Where two intermediate walls are present, a third web connects them. Further intermediate walls and webs can also be employed.

The webs each have a surface flush with end surfaces of the inner and outer walls, and the blocks are devoid of surfaces which lie off a plane containing the flush surfaces of the webs and which face the plane. As a result, the blocks can be formed in a mold and slipped from the mold in a direction perpendicular to the plane. The blocks can be made in a standard concrete block mold machine.

The cross sectional area of each web is made as small as possible while maintaining sufficient strength to hold together the walls of the blocks. In addition, the web is positioned at one end of the block, thereby defining a large open volume between the web and the opposite end of the block. Furthermore, the web is spaced from the top and the bottom of the block to define empty volumes above and below the web. As a result, the block defines vertical and horizontal passages adapted to receive reinforcing bars, insulation, and the like. These latter volumes cooperate with corresponding volumes in the blocks of adjacent courses to define larger horizontal passages.

Each web has a surface which is convex in a cross section generally parallel to the inner wall and the outer wall and concave in a direction transverse to that cross section, so that any water on the surface runs together and drips off. The webs can be molded in one piece with the inner wall and the outer wall or can be formed later. The webs can be made of the material of the inner wall and the outer wall, or can be made of a less heat-conductive material, such as a plastic, to limit heat conduction between the inner and outer walls. The minimal cross-sectional area of the webs also limits such heat conduction.

The interlocking formations are disposed to discourage moisture penetration and comprise recesses on the bottom surfaces of the inner wall and the outer wall and ridges on the top surfaces of the inner wall and the outer wall, or vice versa. The ridges have a shape complementary to the shape of the recesses, so that the ridges fit precisely into the recesses of a like block, and the recesses fit precisely with and support the ridges of a like block. The recesses and ridges have surfaces parallel to the top and bottom surfaces of the inner and outer walls to help bear loads.

The inner wall of the block has an outer surface defining a channel extending the entire length of the inner wall to accommodate wiring, especially in cooperation with the channels of other blocks. With this arrangement, there is no need to break through the wall and run wires through the interior of the blocks. Plateaus on opposite sides of the channel have flat surfaces for the mounting of wallboard without the use of furring strips.

DETAILED DESCRIPTION OF THE PREFERRED EMBODIMENTS

Figure 1:
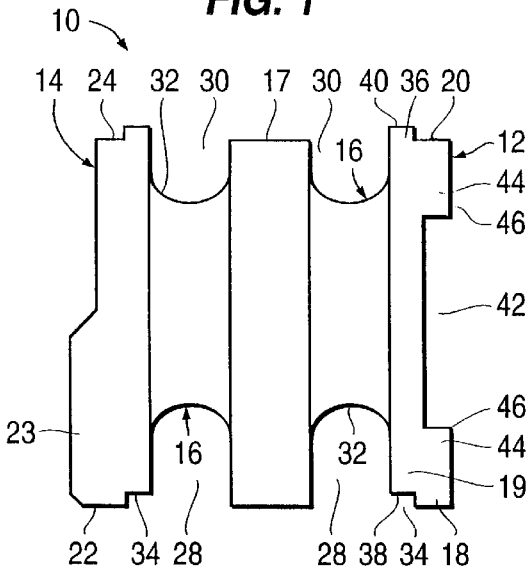
FIG. 1 is an end view of a first embodiment of a block according to the present invention.
Figure 2:
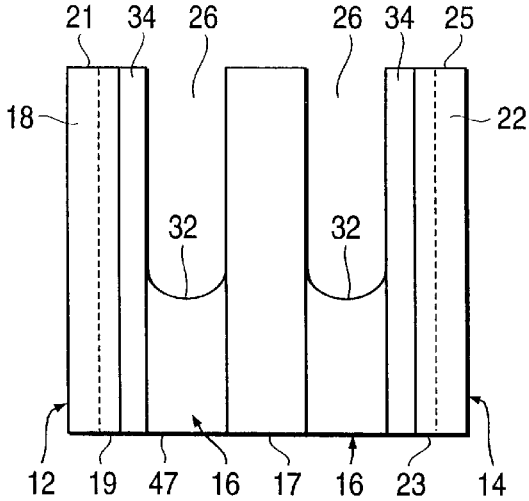
FIG. 2 is a bottom plan view of the block unit of FIG. 1.
Figure 3:
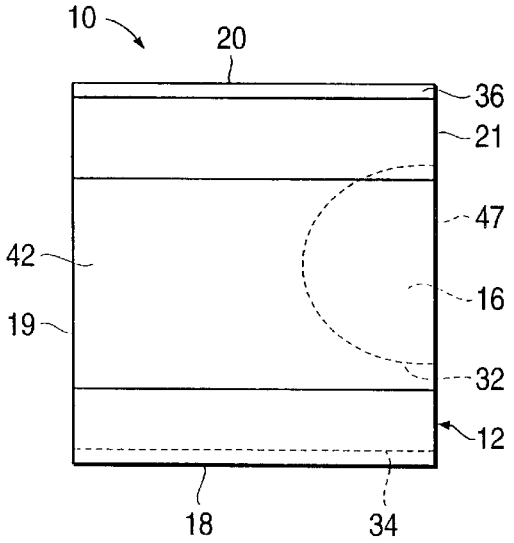
FIG. 3 is a right side view of the block unit of FIG. 1.

As can be seen from FIGS. 1–3, in which a first embodiment of a block, or construction unit, according to the present invention is illustrated and designated generally by the reference numeral 10, the blocks include an inner wall 12 and an outer wall 14, each having four surfaces defining a rectangular perimeter, and an arrangement of webs 16 connecting the inner wall to the outer wall. The four surfaces are indicated by the reference numerals 18–21 for the inner wall 12 and 22–25 for the outer wall 14. The block 10 also includes an intermediate wall 17 which is spaced from and generally parallel to the inner wall 12 and the outer wall 14. A first web 16 connects the inner wall 12 to the intermediate wall 17, and a second web 16 connects the intermediate wall 17 to the outer wall 14.

The area of a cross section of the web 16 generally parallel to the inner wall 12 and the outer wall 14 is made as small as possible while maintaining sufficient strength to hold together the walls. In addition, the webs 16 are positioned at one end of the block 10, thereby defining large open volumes 26 between the webs 16 and the opposite end of the block. In addition, the webs 16 are spaced from the top and the bottom of the block 10 to define empty volumes 28 and 30, respectively, above and below the webs. As a result, the block 10 defines vertical and horizontal passages adapted to receive reinforcing bars, insulation, and the like. These volumes 28 and 30 cooperate with corresponding volumes in the blocks 10 of adjacent courses to define larger horizontal passages. All of the volumes 26, 28 and 30 act as insulating spaces.

Each web 16 has a surface 32 which is convex in a cross section generally parallel to the inner wall 12 and the outer wall 14 and concave in a direction transverse to that cross section, so that any water on the surface 32 runs together and drips off. The webs 16 can be molded in one piece with the inner wall 12 and the outer wall 14 or can be formed or added later. The webs 16 can be made of the material of the inner wall 12 and the outer wall 14, such as concrete, or can be made of a less heat-conductive material, such as a plastic, to limit heat conduction between the inner and outer walls. The plastic is a high strength plastic, such as polypropylene. The minimal cross-sectional area of the web 16 also limits such heat conduction.

The block 10 includes interlocking formations comprising recesses 34 in the bottom surfaces 18 and 22, respectively, of the inner wall 12 and the outer wall 14 and ridges 36 on the top surfaces 20 and 24, respectively, of the inner wall 12 and the outer wall 14. As an alternative, the recesses 34 can be in the top surfaces and the ridges 36 on the bottom surfaces. The recesses 34 extend the entire length of the top surfaces 18 and 22 and have a shape complementary to the shape of the ridges 36, which extend the entire length of the bottom surfaces 20 and 24, so that the ridges 36 fit precisely into the recesses 34 of a like block, and the recesses 34 fit precisely with the ridges 36 of a like block. The recesses 34 and ridges 36 have surfaces 38 and 40, respectively, which are parallel to the top and bottom surfaces 18, 22, 20 and 24 of the inner and outer walls 12 and 14 to help bear loads.

The inner wall 12 has an outer surface defining a channel 42 extending the entire length of the inner wall to accommodate wiring, especially in cooperation with like channels of other blocks. With this arrangement, there is no need to break through the inner wall 12 and run wires through the interior of the blocks. Plateaus 44 on opposite sides of the channel 42 have flat surfaces 46 for the mounting of wallboard without the use of furring strips. The wallboard can be mounted on the plateaus 44 by adhesive or masonry screws.

As can be seen from FIGS. 2 and 3, the web 16 has a surface 47 flush with end surfaces 19 and 23 of the inner and outer walls 12 and 14, and the block 10 is devoid of surfaces which lie off a plane containing the flush surface 47 of the web 16 and which face the plane. The block 10 is slipped from its mold in a downward direction in FIG. 2, which is to the left in FIG. 3. It can be appreciated that any surfaces which lie off the plane containing the flush surface 47 of the web 16 and which face the plane would be destroyed as the block is slipped out of the mold. The block 10 has no such surfaces. As a result, the block can be formed in a mold and slipped from the mold in a direction perpendicular to the plane.

Figure 4:
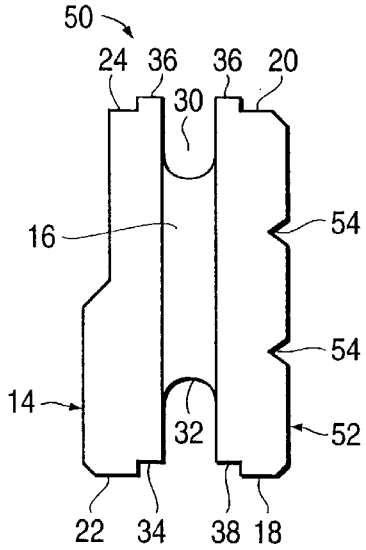
FIG. 4 is an end view of a second embodiment of a block according to the present embodiment.
Figure 5:
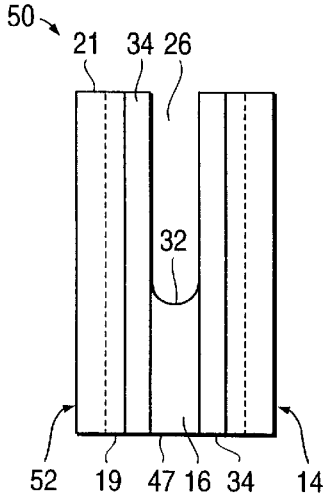
FIG. 5 is a bottom plan view of the block of FIG. 4.

As can be seen from FIGS. 4 and 5, in a second embodiment according to the present invention, a block 50 has an inner wall 52 and an outer wall 14 connected directly to one another by one web 16, without any intermediate walls. The block 50 can be used with like blocks and can be used with the block 10 of the first embodiment, as well as with blocks of other embodiments, the block 50 interlocking with the blocks of other embodiments. The block 50 can be dimensioned such that its inner wall 52 and its outer wall 14 support or are supported by the intermediate wall 17 and either the inner wall 12 or outer wall 14 of the block 10. The inner wall 52 of the block 50 is the same as the inner wall 12 of the block 10, except that the inner wall 52 has two parallel grooves 54 in its outer surface instead of a channel 42. Except as described above, the block 50 is the same as the block 10.

Figure 6:
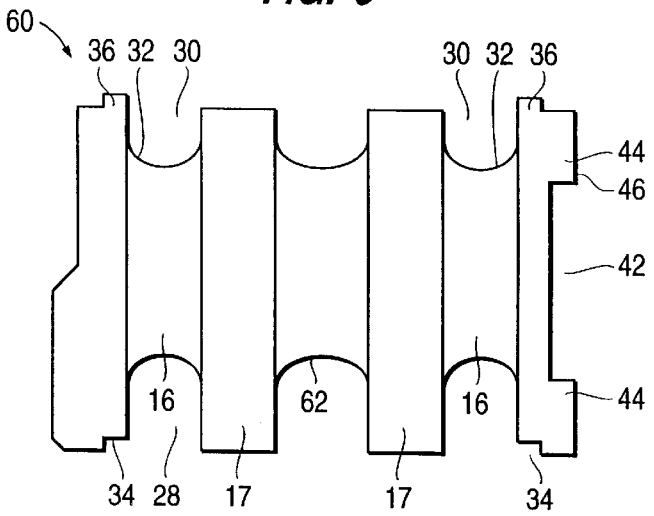
FIG. 6 is an end view of a third embodiment of a block according to the present invention.
Figure 7:
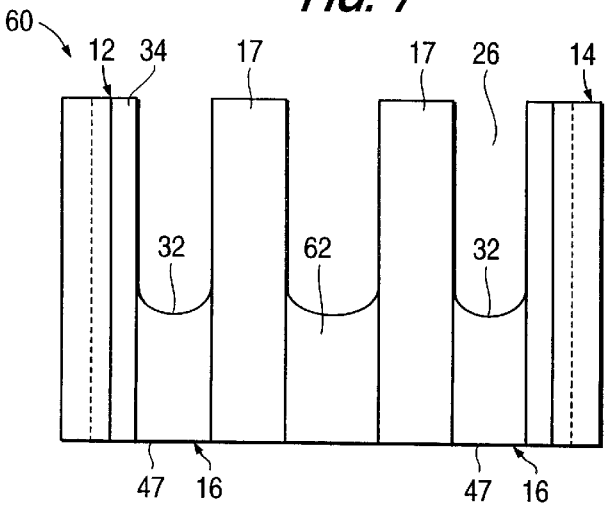
FIG. 7 is a bottom plan view of the block of FIG. 6.
Figure 8:
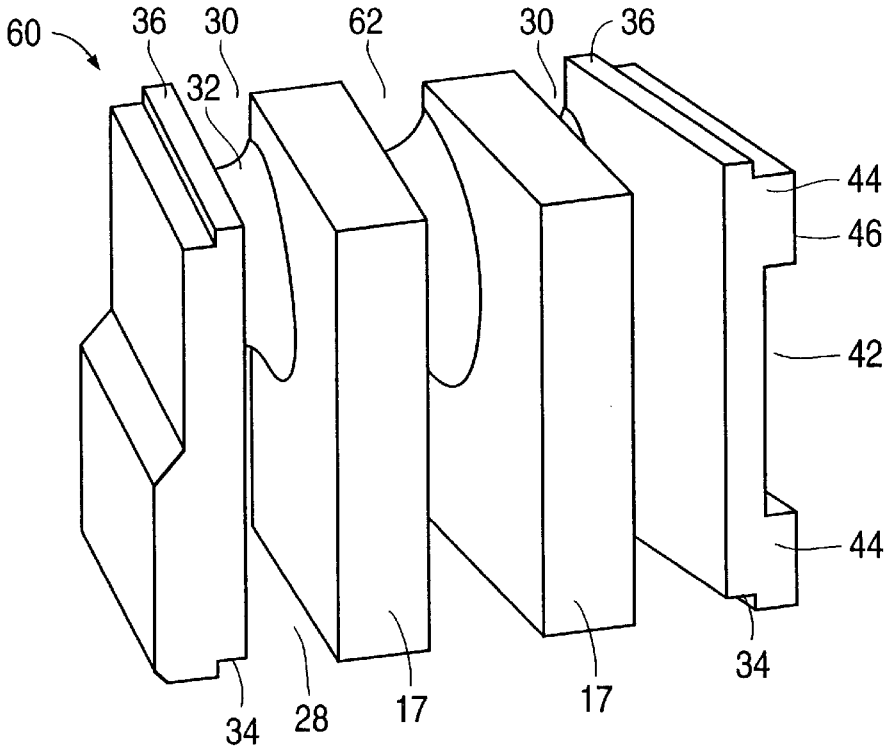
FIG. 8 is a perspective view of the block of FIG. 6.

As can be seen from FIGS. 6–8, in a third embodiment according to the present invention, a block 60 has an inner wall 12, and outer wall 14, and two intermediate walls 17. One of the intermediate walls 17 is connected to the inner wall 12 by a web 16, the other of the intermediate walls 17 is connected to the outer wall 14 by a web 16, and the intermediate walls 17 are connected to one another by a web 62. The web 62 is the same as the webs 16, but can be larger in its dimension perpendicular to the walls. Typically in a block 60, the volumes 26, 28, and 30 between the outer wall 14 and the adjacent intermediate wall 17 are used to form and drain condensation to eliminate moisture. The corresponding volumes between the intermediate walls 17 are used to receive reinforcing bars, and the corresponding volumes between the inner wall 12 and the adjacent intermediate wall 17 receive insulation.

The block 60 can be used with like blocks and can be used with the blocks 10 and 50, as well as with blocks of other embodiments, the block 60 interlocking with the blocks of other embodiments. The block 60 can be dimensioned such that its walls 12, 14 and 17 support or are supported by the walls of blocks of other embodiments. Where the block 60 is used with like blocks, the intermediate walls 17 can support or be supported by the intermediate walls 17 of the like blocks. Except as described above, the block 60 is the same as the block 10.

Figure 9:
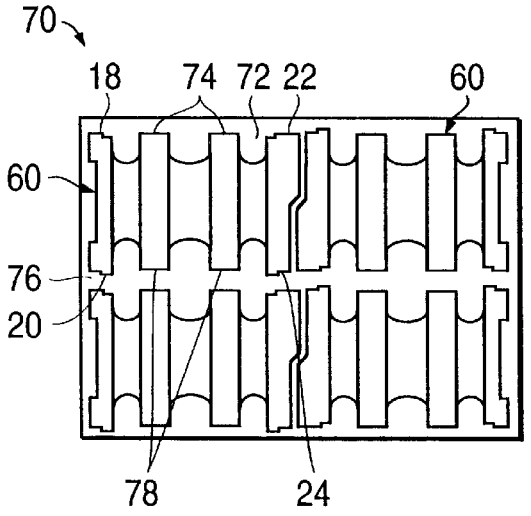
FIG. 9 is a top plan view of a mold containing a plurality of the blocks of FIG. 6.

As can be appreciated from FIG. 9, which is a top plan view of four blocks 60 in a mold 70, the blocks according to the present invention are molded such that the surfaces that will be the tops and bottoms of the blocks in use are formed by sides of the mold. For example, the mold 70 includes a side wall 72 having a configuration which forms the top surfaces 18 and 22 of the inner wall 12 and the outer wall 14, respectively, and top surfaces 74 of the intermediate walls 17 of one of the blocks 60. A partition wall 76 of the mold 70 has a configuration which forms the bottom surfaces 20 and 24 of the inner wall 12 and the outer wall 14, respectively, and the bottom surfaces 78 of the intermediate walls 17 of that block. The top and bottom surfaces of the other blocks 60 in the mold 70 are formed in a similar manner. Two of the blocks 60 in the mold 70 are oriented upside down relative to the other two blocks for more efficient use of mold space.

The mold 70 is typically made of steel and its dimensions are very precise. Thus, the distances between the side wall 72 and the partition wall 76 are very precise. As a result, the distances between the tops and the bottoms of the blocks 60 in the mold 70 are very precise. Furthermore, since the blocks 60 are removed from the mold 70 by sliding the blocks in a direction parallel to the walls of the mold, which is parallel to the tops and bottoms of the blocks, the precise distances between the tops and bottoms are retained after the blocks have been slipped from the mold. The variation in the distance between the top and the bottom of a block according to the present invention is on the order of 0.01 inch, and no greater than 0.05 inch. With such precision, walls can be constructed without the use of mortar at the bed joints.

The mold 70 fits into a standard mold machine of the type which makes standard concrete blocks. The same is true of molds for making the other embodiments of the present invention. Therefore, the blocks according to the present invention can be made in a standard concrete block mold machine.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

What is claimed is:

1. A construction unit comprising:

an inner wall;

an outer wall substantially parallel to said inner wall; and a web arrangement connecting said outer wall to said inner wall, wherein said inner wall and said outer wall together define an upper surface and a lower surface, both said surfaces are for engagement with adjacent courses of construction units, said construction unit has a height between said upper surface and said lower surface, and said upper surface and said lower surface are formed by engagement of said upper surface and said lower surface with walls of a mold from which the construction unit is slipped in a direction parallel to said walls of the mold, wherein said web arrangement comprises a web having, in a cross section parallel to said inner wall and said outer wall, a convex surface, wherein said convex surface has a first end, a second end, a first side, and a second side, said convex surface is continuously convex from said first end to said second end, and said convex surface is continuously concave from said first side to said second side in a direction generally transverse to said first and second sides.

2. The construction unit of claim 1, wherein said height at any point on the upper surface varies from said height at any other point on the upper surface by no more than 0.05 inches.

3. The construction unit of claim 2, wherein said upper surface and said lower surface are flat.

4. The construction unit of claim 1, wherein said inner wall, said outer wall and said web arrangement are formed in one piece.

5. The construction unit of claim 1, further comprising interlocking means integral with at least one of said inner wall and said outer wall for interlocking the construction unit with a like construction unit.

6. The construction unit of claim 5, wherein said means for interlocking comprises a structure formed in one piece with at least one of said inner wall and said outer wall.

7. The construction unit of claim 6, wherein said inner wall and said outer wall each have four surfaces defining a rectangular perimeter, and said interlocking means comprises a ridge protruding upward from at least one of said four surfaces.

8. The construction unit of claim 7, wherein said ridge has a flat top surface, and said recess has a flat bottom surface, and said top surface, said bottom surface, the surface from which the ridge protrudes, and the surface into which the recess extends are all flat and parallel to a variance of no more than 0.05 inches.

9. The construction unit of claim 7, wherein said interlocking means further comprises a recess extending into another one of said four surfaces a side of the rectangular perimeter opposite from said one of said four surfaces, said recess being sized and shaped to entirely receive said ridge, whereby said recess is sized and shaped to entirely receive the ridge of a like construction unit.

10. The construction unit of claim 9, wherein said interlocking means comprises two of said ridges and two of said recesses.

11. The construction unit of claim 9, wherein said recess extends the entire length of said another one of said four surfaces.

12. The construction unit of claim 9, further comprising at least one intermediate wall between, parallel to, and spaced from said inner wall and said outer wall, wherein said web arrangement comprises at least two webs, including a first web connecting said intermediate wall to said inner wall and a second web connecting said intermediate wall to said outer wall.

13. The construction unit of claim 12, wherein said intermediate wall has four surfaces defining a rectangular perimeter, including a first surface coplanar with the surface from which the ridge protrudes and a second surface coplanar with the surface into which the recess extends.

14. The construction unit of claim 1, wherein said inner wall and said outer wall have four surfaces defining a rectangular perimeter of the wall, and the web arrangement has an outer surface positioned inside the perimeter of the rectangle and spaced from three of said four surfaces, whereby passages extending transverse to one another are defined in the construction unit.

15. The construction unit of claim 1, wherein said inner wall has an outer surface and a channel extending entirely across said outer surface to accommodate wiring.

16. The construction unit of claim 15, further comprising plateaus extending parallel to said channel, said plateaus positioned on opposite sides of said channel.

17. The construction unit of claim 1, wherein one of said ends of said convex surface has a point which is the closest point on the web to said lower surface of the construction unit.

18. The construction unit of claim 1, wherein the construction unit is made of concrete.

19. The construction unit of claim 1, wherein said height at any point on the upper surface varies from said height at any other point on the upper surface by no more than approximately 0.01 inches.

20. The construction unit of claim 19, wherein said upper surface and said lower surface are flat.

21. A construction unit comprising:

an inner wall;

an outer wall substantially parallel to said inner wall; and a web arrangement connecting said outer wall to said inner wall, wherein said inner wall and said outer wall together define an upper surface and a lower surface, both said surfaces are for engagement with adjacent courses of construction units, said construction unit has a height between said upper surface and said lower surface, and said upper surface and said lower surface are formed by engagement of said upper surface and said lower surface with walls of a mold from which the construction unit is slipped to a direction parallel to said walls of the mold, wherein said inner wall and said outer wall each have an end surface, said web has a surface flush with at least one of said end surfaces, and the construction unit is devoid of surfaces which lie off a plane containing the flush surface of the web and which face said plane, whereby said construction unit is capable of being formed in and slipped out of a mold in a direction perpendicular to said plane.

* * * * *